US011036156B2

(12) United States Patent
Ogino et al.

(10) Patent No.: US 11,036,156 B2
(45) Date of Patent: Jun. 15, 2021

(54) TONER, DEVELOPER, TONER STORED UNIT, IMAGE FORMING APPARATUS, IMAGE FORMING METHOD, AND PRINTED MATTER PRODUCING METHOD

(71) Applicants: Kohtaroh Ogino, Shizuoka (JP); Masayuki Ishii, Shizuoka (JP); Masayuki Kakimoto, Shizuoka (JP); Shohichi Sugimoto, Shizuoka (JP)

(72) Inventors: Kohtaroh Ogino, Shizuoka (JP); Masayuki Ishii, Shizuoka (JP); Masayuki Kakimoto, Shizuoka (JP); Shohichi Sugimoto, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/778,268

(22) Filed: Jan. 31, 2020

(65) Prior Publication Data

US 2020/0272067 A1 Aug. 27, 2020

(30) Foreign Application Priority Data

Feb. 22, 2019 (JP) ..... JP2019-030686

(51) Int. Cl.
*G03G 9/08* (2006.01)
*G03G 9/097* (2006.01)
(Continued)

(52) U.S. Cl.
CPC ..... *G03G 9/09716* (2013.01); *G03G 9/0819* (2013.01); *G03G 9/08755* (2013.01);
(Continued)

(58) Field of Classification Search
CPC ..... G03G 9/09716; G03G 9/0819; G03G 9/09725
(Continued)

(56) References Cited

U.S. PATENT DOCUMENTS

2003/0039912 A1* 2/2003 Schein ..... G03G 9/09708 430/123.51
2007/0287090 A1* 12/2007 Eida ..... G03G 9/0821 430/108.7
(Continued)

FOREIGN PATENT DOCUMENTS

| | | |
|---|---|---|
| JP | 5-061244 | 3/1993 |
| JP | 2006-259705 | 9/2006 |
| JP | 2010-184863 | 8/2010 |

OTHER PUBLICATIONS

U.S. Appl. No. 16/492,818, filed Feb. 15, 2018, Naoko Kitada, et al.

*Primary Examiner* — Mark A Chapman
(74) *Attorney, Agent, or Firm* — Oblon, McClelland, Maier & Neustadt, L.L.P.

(57) ABSTRACT

A toner is provided which includes: a toner base particle including a binder resin; and an external additive including inorganic particles. A particle size distribution of primary particles of the inorganic particles has a plurality of peaks in the range of from 5 nm through 50 nm. The particle size distribution of the primary particles satisfies all of expressions (1) to (3) below:

$$n1d > n2d \quad (1);$$

$$10 < (n1d + n2d) \quad (2); \text{ and}$$

$$30 \leq \{(n2h/n1h) \times 100\} < 100 \quad (3),$$

where n1d is a particle diameter (nm) at a peak n1 which is the highest peak among the plurality of peaks and n2d is a particle diameter (nm) of a peak n2 which is the second highest peak among the plurality of peaks, and n1h is a height of the peak n1 and n2h is a height of the peak n2.

9 Claims, 5 Drawing Sheets

(51) Int. Cl.
*G03G 15/08* (2006.01)
*G03G 9/09* (2006.01)
*G03G 9/087* (2006.01)

(52) U.S. Cl.
CPC ..... *G03G 9/0904* (2013.01); *G03G 9/09725* (2013.01); *G03G 15/0865* (2013.01)

(58) Field of Classification Search
USPC ..... 430/108.6, 111.4
See application file for complete search history.

(56) References Cited

U.S. PATENT DOCUMENTS

| | | | |
|---|---|---|---|
| 2008/0280224 | A1 | 11/2008 | Inoue et al. |
| 2009/0074467 | A1 | 3/2009 | Seshita et al. |
| 2011/0136051 | A1 | 6/2011 | Ishii et al. |
| 2011/0136057 | A1 | 6/2011 | Ohtaki et al. |
| 2011/0229814 | A1 | 9/2011 | Kakimoto et al. |
| 2012/0237867 | A1 | 9/2012 | Ishii |
| 2013/0149640 | A1 | 6/2013 | Ishii |
| 2013/0164665 | A1 | 6/2013 | Ishii et al. |
| 2014/0113226 | A1 | 4/2014 | Ishii et al. |
| 2014/0134527 | A1 | 5/2014 | Ishii |
| 2015/0212442 | A1 | 7/2015 | Ishii et al. |
| 2017/0082933 | A1 | 3/2017 | Dan et al. |
| 2017/0212442 | A1 | 7/2017 | Ogino et al. |
| 2018/0120724 | A1 | 5/2018 | Sakata et al. |
| 2018/0267418 | A1 | 9/2018 | Ogino et al. |
| 2018/0329326 | A1 | 11/2018 | Matsushita et al. |
| 2019/0278191 | A1 | 9/2019 | Suzuki et al. |
| 2020/0026210 | A1 | 1/2020 | Hirai et al. |

* cited by examiner

TONER, DEVELOPER, TONER STORED UNIT, IMAGE FORMING APPARATUS, IMAGE FORMING METHOD, AND PRINTED MATTER PRODUCING METHOD

CROSS-REFERENCE TO RELATED APPLICATIONS

This patent application is based on and claims priority pursuant to 35 U.S.C. § 119(a) to Japanese Patent Application No. 2019-030686, filed on Feb. 22, 2019 in the Japan Patent Office, the entire disclosure of which is hereby incorporated by reference herein.

BACKGROUND

Technical Field

The present disclosure relates to a toner, a developer, a toner stored unit, an image forming apparatus, an image forming method, and a printed matter producing method.

Description of the Related Art

Hitherto, electric or magnetic latent images in, for example, electronic photographic apparatuses and electrostatic recording apparatuses are visualized with a toner for electrostatic development (which is also referred to simply as a "toner" in the present disclosure). In electrophotography, for example, an electrostatic latent image is formed on a photoconductor, where the electrostatic latent image is developed with a toner to form a toner image. The toner image is typically transferred onto an image-receiving material such as paper, following by fixing through heating or other means.

In recent years, intended purposes of image forming apparatuses have been diversified, and there is an increased need for high-speed processing and downsizing of image forming apparatuses. In response to this, stress applied on the toner in the image forming apparatuses increases, which makes it difficult to prevent contamination to the photoconductor and stably form a toner layer on a developing roller for a long period of time.

SUMMARY

According to one aspect of the present disclosure, a toner is provided which includes: a toner base particle including a binder resin; and an external additive including inorganic particles. A particle size distribution of primary particles of the inorganic particles has a plurality of peaks in the range of from 5 nm through 50 nm. The particle size distribution of the primary particles satisfies all of expressions (1) to (3) below:

$$n1d > n2d \quad (1);$$

$$10 < (n1d + n2d) \quad (2); \text{ and}$$

$$30 \leq \{(n2h/n1h) \times 100\} < 100 \quad (3),$$

where n1d is a particle diameter (nm) at a peak n1 which is the highest peak among the plurality of peaks and n2d is a particle diameter (nm) of a peak n2 which is the second highest peak among the plurality of peaks, and n1h is a height of the peak n1 and n2h is a height of the peak n2.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
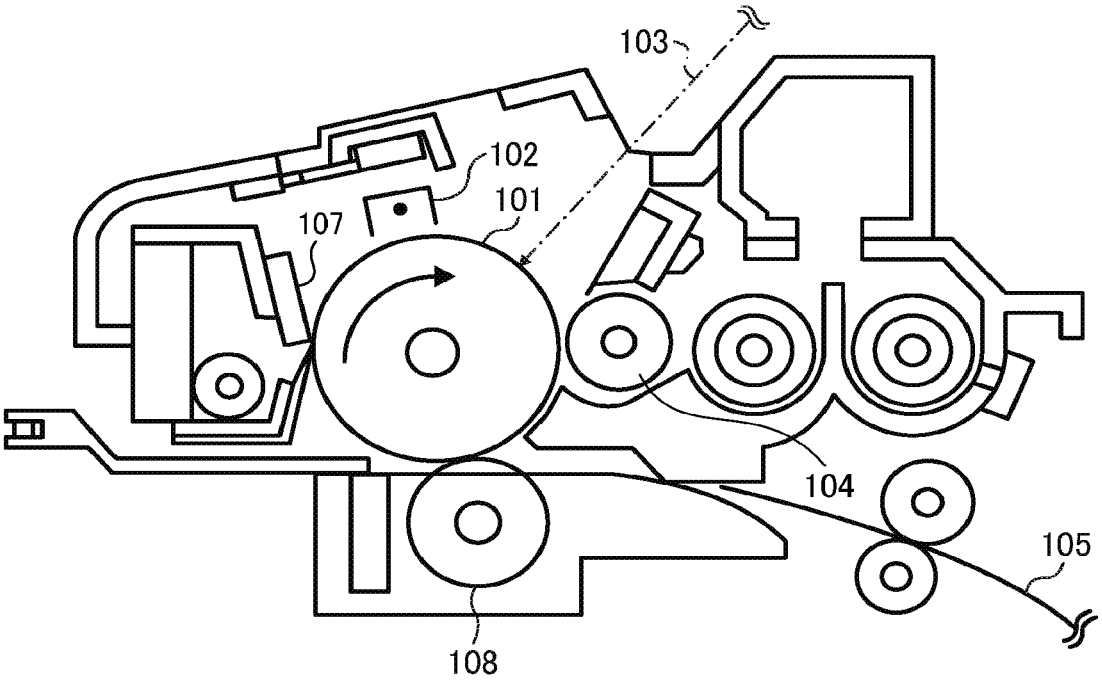
FIG. 1 is an explanatory view illustrating one embodiment of a process cartridge.

The accompanying drawings are intended to depict embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

An already known toner that was made for increasing stress resistance of the toner includes toner base particles to which both small-particle-diameter metal oxide particles and large-particle-diameter metal oxide particles are externally added. In this toner, the spacer effects of the metal oxide particles with large particle diameters prevent the metal oxide particles with small particle diameters from being embedded in the toner surface due to stress in the image forming apparatus.

However, a recently required toner having higher stress resistance has not yet been provided. In other words, any existing toner is not satisfactory from the viewpoints of stability of the amount of a toner conveyed on a developing roller and prevention of contamination to the photoconductor.

Related art discloses a method for producing hydrophobic inorganic particles, the method including performing hydrophobization while stirring a mixture of small-particle-diameter inorganic particles and large-particle-diameter inorganic particles in the same process tank, for providing hydrophobic inorganic particles that can provide a toner with excellent fluidity, charging ability, and durability.

However, this technique has not yet been able to provide a toner with a high level of stress resistance that is required in response to high-speed processing and downsizing of an image forming apparatus.

According to the present disclosure, a toner is provided that can be conveyed on a developing roller in a stable amount and sufficiently prevented from contaminating an electrostatic latent image bearer.

Hereinafter, embodiments of the present disclosure will be described in more detail.

Specifically, a toner of the present disclosure includes: a toner base particle including a binder resin; and an external additive. The external additive, which coats the toner base particles, includes inorganic particles. A particle size distribution of primary particles of the inorganic particles has a plurality of peaks in the range of from 5 nm through 50 nm. The particle size distribution of the primary particles satisfies all of expressions (1) to (3) below:

$$n1d > n2d \quad (1);$$

$$10 < (n1d + n2d) \quad (2); \text{ and}$$

$$30 \leq \{(n2h/n1h) \times 100\} < 100 \quad (3),$$

where n1d is a particle diameter (nm) at a peak n1 which is the highest peak among the plurality of peaks and n2d is a particle diameter (nm) at a peak n2 which is the second highest peak among the plurality of peaks, and n1h is a height of the peak n1 and n2h is a height of the peak n2.

Satisfying the expressions (1) to (3) means that the inorganic particles serving as the external additive contain two kinds of inorganic particles; i.e., small-particle-diameter inorganic particles and large-particle-diameter inorganic particles, and the large-particle-diameter inorganic particles are contained in the external additive more than the small-particle-diameter inorganic particles.

In the related techniques, the small-particle-diameter inorganic particles are made responsible for imparting stress resistance, and the large-particle-diameter inorganic particles are added as a spacer, which prevents the small-particle-diameter inorganic particles from being embedded in the toner surface. Therefore, the small-particle-diameter inorganic particles are added more than the large-particle-diameter inorganic particles. The related techniques, however, have difficulty in sufficiently preventing the small-particle-diameter inorganic particles from being embedded.

As a result of extensive studies, the inventors of the present invention have obtained the finding that when the amount of large-particle-diameter inorganic particles added is set to be in a specific range, it is possible to increase stress resistance of the resultant toner and to sufficiently prevent contamination to an electrostatic latent image bearer. The present invention has been accomplished on the basis of this finding. The large-particle-diameter inorganic particles are not easily embedded in the toner surface, and can sufficiently exhibit the above effect.

The particle size distribution of the inorganic particles as used herein is a particle size distribution on the number basis of primary particles of the inorganic particles, and can be measured by sequentially performing steps (1) to (3) below.

(1) An image of the toner is obtained using a scanning electron microscope SU8200 series (available from Hitachi High-Technologies Corporation) in a state where the inorganic particles are attached on the toner surface.

(2) The image obtained is binarized using image processing software "A-zokun" (available from Asahi Kasei Engineering Corporation) to calculate circle-equivalent diameters of the inorganic particles. One-thousand inorganic particles are measured for the circle-equivalent diameters of the inorganic particles.

(3) The number of classes is determined based on a formula below, and a histogram is created to obtain a particle size distribution.

The number of classes=$1+\log_2 n$ (n denotes the number of data of the equivalent circle diameters of the inorganic particles).

As described above, the particle size distribution of the primary particles of the inorganic particles used in the present disclosure has a plurality of peaks in the range of from 5 nm through 50 nm and satisfies all of the expressions (1) to (3). Specifically, n1d, which is the particle diameter (nm) at the peak n1, is preferably from 15 nm through 50 nm, more preferably from 20 nm through 40 nm, and n2d, which is the particle diameter (nm) at the peak n2, is preferably from 5 nm through 50 nm, more preferably from 10 nm through 20 nm.

The difference between n1d and n2d is preferably from 10 nm through 45 nm, more preferably from 13 nm through 30 nm.

From the viewpoint of increasing the effects of the present disclosure, the expressions (2) and (3) are more preferably expressions (20) and (30) below, respectively:

$$20 < (n1d + n2d) \quad (20); \text{ and}$$

$$40 < \{(n2h/n1h) \times 100\} < 90 \quad (30).$$

In the present disclosure, a method for allowing the particle size distribution of the primary particles of the inorganic particles to have a plurality of peaks in the range of from 5 nm through 50 nm and to satisfy all of the expressions (1) to (3) is, for example, a method including providing two or more kinds of inorganic particles having different average particle diameters and adjusting the amounts of the two or more kinds of inorganic particles so as to satisfy the expression (1) to (3). Note that, the inorganic particles are preferably of the same kind.

The kind of the inorganic particles as used in the present disclosure is not particularly limited. Examples thereof include, but are not limited to, silica, alumina, titania, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red oxide, antimony trioxide, magnesium oxide, zirconium oxide, barium sulfate, barium carbonate, calcium carbonate, silicon carbide, and silicon nitride. Among them, at least one selected from the group consisting of silica (including hydrophobic silica), alumina, and titania is preferable from the viewpoint of increasing stress resistance.

The inorganic particles may be subjected to a hydrophobization treatment. In the hydrophobization treatment, for example, hydrophilic particles may be treated with a silane coupling agent such as methyltrimethoxysilane, methyltriethoxysilane, or octyltrimethoxysilane. Alternatively, the inorganic particles may be thermally treated with silicone oil for the hydrophobization treatment.

Examples of the silicone oil include, but are not limited to, dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy polyether-modified silicone oil, phenol-modified silicone oil, carboxyl-modified silicone oil, mercapto-modified silicone oil, methacryl-modified silicone oil, and α-methyl styrene-modified silicone oil.

The inorganic particles may be a commercially available product. Examples of commercially available silica include, but are not limited to, R972, R974, RX200, RY200, R202, R805, and R812 (all of which are available from NIPPON AEROSIL CO., LTD.). Examples of commercially available titania include, but are not limited to, P-25 (available from NIPPON AEROSIL CO., LTD.), STT-30 and STT-65C-S (both of which are available from Titan Kogyo, Ltd.), TAF-140 (available from Fuji Titanium Industry Co., Ltd.), MT-150W, MT-500B, MT-600B, and MT-150A (all of which are available from TAYCA CORPORATION). Examples of commercially available hydrophobized titania particles include, but are not limited to, T-805 (available from NIPPON AEROSIL CO., LTD.), STT-30A and STT-65S-S (both of which are available from Titan Kogyo, Ltd.), TAF-500T and TAF-1500T (both of which are available from Fuji Titanium Industry Co., Ltd.), MT-100S and MT-100T (both of which are available from TAYCA CORPORATION), and IT-S (available from ISHIHARA SANGYO KAISHA, LTD.).

The specific surface area of the inorganic particles determined by the BET method is preferably from 20 $m^2/g$ through 500 $m^2/g$, more preferably from 30 $m^2/g$ through 400 $m^2/g$, from the viewpoint of increasing stress resistance.

In addition to the inorganic particles, fatty acid metal salts (e.g., zinc stearate and aluminum stearate), fluoropolymers, and others may be used as the external additive in combination with the inorganic particles.

The proportion of the inorganic particles in the toner of the present disclosure is, for example, from 1% by mass through 5% by mass, preferably from 1.5% by mass through 4% by mass.

(Toner Base Particles)

The toner base particles in the present disclosure each include a binder resin. Any know material may be used as the materials of the toner base particles.

[Binder Resin]

Examples of the binder resin include, but are not limited to: polymers of styrene and substituted styrene such as polystyrene, poly p-chlorostyrene, and polyvinyltoluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer; polymethyl methacrylate; polybutyl methacrylate; polyvinyl chloride; polyvinyl acetate; polyethylene; polypropylene; polyester; epoxy resins; epoxy polyol resins; polyurethane; polyamide, polyvinyl butyral; polyacrylic resins; rosins; modified rosins; terpene resins; aliphatic or alicyclic hydrocarbon resins; aromatic petroleum resins; chlorinated paraffin; and paraffin waxes. These may be used alone or in combination.

[Colorant]

As a colorant, any known dye and pigment may be used. Examples of the dyes and pigments include, but are not limited to, carbon black, a nigrosine dye, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), Vulcan fast yellow (5G, R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, p-chloro-o-nitro aniline red, lithol fast scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, permanent red FSR, brilliant carmine 6B, pigment scarlet 3B, Bordeaux 5B, tolui dine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS, BC), indigo, ultramarine, Prussian blue, anthraquinone blue, fast violet B, methyl violet lake, cobalt violet, manganese violet, dioxane violet, antraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, lithopone, and mixtures of the foregoing. The amount of the colorant used is generally from 0.1 parts by mass through 50 parts by mass relative to 100 parts by mass of the binder resin.

[Charging-Controlling Agent]

As a charging-controlling agent, any known material may be used. Examples of the charging-controlling agent include, but are not limited to, nigrosine-based dyes, triphenylmethane-based dyes, chromium-containing metal complex dyes, molybdic acid chelate pigments, rhodamine-based dyes, alkoxy-based amine, quaternary ammonium salts (including fluorine-modified quaternary ammonium salts), alkyl amide, a simple substance or compounds of phosphorus, a simple substance or compounds of tungsten, fluorine-based activators, metal salts of salicylic acid, and metal salts of salicylic acid derivatives.

The amount of the charging-controlling agent used in the present disclosure is not flatly determined because the amount thereof is determined depending on the kind of the binder resin, the presence or absence of an optionally used additive, and the toner production method including a dispersion method. The amount of the charging-controlling agent used is preferably within the range of from 0.1 parts by mass through 10 parts by mass, more preferably within the range of from 2 parts by mass through 5 parts by mass, relative to 100 parts by mass of the binder resin. If necessary, a plurality of charging-controlling agents may be used in combination.

[Release Agent]

In the present disclosure, a release agent may be used to impart releasability to the toner. The softening point of the release agent used is preferably from 70° C. through 100° C.

Examples of the release agent include, but are not limited to: synthetic waxes such as low-molecular-weight polyethylene and polypropylene, and copolymers thereof; vegetable waxes such as candelilla wax, carnauba wax, rice wax, Japanese wax, and jojoba wax; animal waxes such as beeswax, lanolin, and spermaceti; mineral waxes such as montan wax and ozokerite; and oil and fat waxes such as hydrogenated castor oil, hydroxystearic acid, fatty acid amide, and phenol fatty acid esters.

In terms of the chemical structure of the wax, hydrocarbon-based waxes, ester-based waxes, and amide-based waxes are known. Among them, ester-based waxes are suitable from the viewpoints of, for example, storage ability, image quality, and fixable temperature range.

The amount of the release agent in the toner is suitably from 1 part by mass through 6 parts by mass.

A method for producing the toner in the present disclosure may be any known method in the art. Examples of the method include, but are not limited to, a production method including performing steps of mixing toner raw materials, kneading, rolling and cooling, pulverizing, and classifying. In this method, for example, after raw materials are mixed, the resultant mixture is kneaded using a twin-screw kneader, cooled using a belt-type cooling machine, pulverized using a jet mill, and classified to obtain a toner.

The weight average particle diameter of the toner is preferably from 4 μm through 10 μm, more preferably from 5 μm through 8 μm.

(Developer)

A developer of the present disclosure includes the toner of the present disclosure, and may be used as, for example, a dry-type monocomponent developer (or a one-component developer) or a dry-type two-component developer (or a two-component developer). When the developer of the present disclosure is a dry-type two-component developer, the amounts of a carrier and the toner of the present disclosure to be mixed together are preferably such that toner particles adhere to the surfaces of carrier particles to occupy 30% to 90% of the surface area of each carrier particle.

Examples of the carrier used include, but are not limited to, known products in the art such as iron powder, ferrite, and glass beads. The carrier may be a carrier coated with a resin. Examples of the resin used include, but are not limited to, carbon polyfluoride, polyvinyl chloride, polyvinylidene chloride, phenol resins, polyvinyl acetal, and silicone resins.

In any case, an appropriate mixing ratio between the toner and the carrier is from about 0.5 parts by mass through about 6.0 parts by mass of the toner relative to 100 parts by mass of the carrier.

(Toner Stored Unit)

A toner stored unit of the present disclosure includes a toner and a unit configured to store the toner, the toner being stored in the unit. Here, examples of the toner stored unit include, but are not limited to, toner stored containers, developing devices, and process cartridges.

The toner stored container is a container that stores the toner.

The developing device includes a unit that stores the toner and is configured to perform development.

The process cartridge includes an electrostatic latent image bearer and a developing unit which are integrally supported. The process cartridge stores the toner and is detachably mountable to an image forming apparatus. The process cartridge may further include at least one selected from the group consisting of a charging unit, an exposing unit, and a cleaning unit.

Next, one embodiment of the process cartridge is illustrated in FIG. 1. As illustrated in FIG. 1, the process cartridge of the present embodiment includes an electrostatic latent image bearer 101, a charging device 102, a developing device 104, and a cleaning part 107, and further includes other units if necessary. In FIG. 1, reference numeral 103 denotes exposure from an exposing device and reference numeral 105 denotes a recording paper sheet.

The electrostatic latent image bearer 101 may be the same as that used in an image forming apparatus that will be described hereinafter. The charging device 102 includes any charging member.

An image forming process using the process cartridge illustrated in FIG. 1 is described below. While rotated in a clockwise direction, the electrostatic latent image bearer 101 undergoes charging from the charging device 102 and the exposure 103 from an exposing unit to form an electrostatic latent image corresponding to the exposure image on the surface of the electrostatic latent image bearer 101.

The electrostatic latent image is developed with the toner by the developing device 104, and the image developed with the toner is transferred onto a recording paper sheet 105 by a transfer roller 108 and is printed out. The surface of the latent image bearer after the image has been transferred is cleaned by the cleaning part 107, and undergoes charge-eliminating by a charge-eliminating unit. The procedure described above is repeated again.

(Image Forming Method and Image Forming Apparatus)

An image forming method of the present disclosure includes a step of forming an image with a developer, specifically, an electrostatic latent image forming step (i.e., a charging step and an exposing step), a developing step, a transfer step, and a fixing step, and further includes other steps appropriately selected if necessary (e.g., a charge-eliminating step, a cleaning step, a recycling step, and a controlling step).

An image forming apparatus of the present disclosure includes an electrostatic latent image bearer, an electrostatic latent image forming unit (i.e., a charging unit and an exposing unit) configured to form an electrostatic latent image on the electrostatic latent image bearer, a developing unit configured to develop the electrostatic latent image with a developer to form a visible image, a transfer unit configured to transfer the visible image onto a recording medium, and a fixing unit configured to fix the visible image transferred on the recording medium. The image forming apparatus of the present disclosure further includes other steps appropriately selected if necessary (e.g., a charge-eliminating unit, a cleaning unit, a recycling unit, and a controlling unit).

In the method and the apparatus of the present disclosure, the developer includes the toner of the present disclosure.

—Electrostatic Latent Image Forming Step and Electrostatic Latent Image Forming Unit—

The electrostatic latent image forming step is a step of forming an electrostatic latent image on an electrostatic latent image bearer.

A material, shape, structure, and size of the electrostatic latent image bearer (which may be also referred to as an "electrophotographic photoconductor" or a "photoconductor") are not particularly limited and may be appropriately selected from materials, shapes, structures, and sizes known in the art. Preferable examples of the shape include, but are not limited to, a drum-shape. Examples of the material include, but are not limited to, amorphous silicon and selenium which form inorganic photoconductors; and polysilane and phthalopolymethine which form organic photoconductors (OPC). Among them, organic photoconductors (OPC) are preferable because an image with higher resolution can be obtained.

For example, the electrostatic latent image can be formed by uniformly charging a surface of the electrostatic latent image bearer and then exposing the surface of the electrostatic latent image bearer to light imagewise. The electrostatic latent image can be formed by an electrostatic latent image forming unit.

The electrostatic latent image forming unit includes, for example, a charging unit (charger) configured to uniformly charge the surface of the electrostatic latent image bearer, and an exposing unit (exposure device) configured to expose the surface of the electrostatic latent image bearer to light imagewise.

The charging can be performed by, for example, applying voltage to the surface of the electrostatic latent image bearer using the charger.

The charger is not particularly limited and may be appropriately selected depending on the intended purpose. Examples of the charger include, but are not limited to, known contact chargers equipped with a conductive or semiconductive roller, brush, film, or rubber blade, and non-contact chargers utilizing corona discharge such as corotron and scorotron.

The charger is preferably a charger that is disposed in contact with or without contact with the electrostatic latent image bearer and is configured to superimpose and apply DC and AC voltages to charge the surface of the electrostatic latent image bearer.

The charger is preferably a charging roller disposed adjacent to the electrostatic latent image bearer via a gap tape without contact with the electrostatic latent image bearer, where DC and AC voltages are superimposed and applied to the charging roller to charge the surface of the electrostatic latent image bearer.

The exposure can be performed by, for example, exposing the surface of the electrostatic latent image bearer to light imagewise using the exposure device.

The exposure device is not particularly limited and may be appropriately selected depending on the intended purpose, as long as the exposure device can apply to light to a surface of the electrostatic latent image bearer charged by the charger in an intended imagewise manner. Examples of the exposure device include, but are not limited to, various exposure devices such as radiation optical exposure devices, rod-lens array exposure devices, laser optical exposure devices, and liquid crystal shutter optical exposure devices.

In the present disclosure, a back light system configured to perform imagewise exposure from a back side of the electrostatic latent image bearer may be employed.

—Developing Step and Developing Unit—

The developing step is a step of developing the electrostatic latent image with the toner to form a visible image.

The visible image can be formed by, for example, developing the electrostatic latent image with the toner and can be formed by the developing unit.

An example of the developing unit is suitably a developing unit that stores the toner and includes a developing device capable of providing the toner to the electrostatic latent image in a contact or non-contact manner. It is more preferable that the developing unit be, for example, a developing device including a toner stored container.

The developing device may be a developing device for a single color or a developing device for multiple colors. Preferable examples of the developing device include, but are not limited to, a developing device including a stirrer configured to stir the toner to cause friction to charge the toner, and a rotatable magnetic roller.

In the developing device, for example, the toner is mixed and stirred to cause friction, and the friction charges the toner. The charged toner is held on a surface of the rotating magnetic roller in the form of a brush to form a magnetic brush. Since the magnet roller is disposed near the electrostatic latent image bearer (photoconductor), part of the toner constituting the magnetic brush formed on the surface of the magnetic roller is transferred onto a surface of the electrostatic latent image bearer (photoconductor) by the action of electrical attractive force. As a result, the electrostatic latent image is developed by the toner to form a visible image of the toner on the surface of the electrostatic latent image bearer (photoconductor).

—Transfer Step and Transfer Unit—

The transfer step is a step of transferring the visible image onto a recording medium. A preferable embodiment of the transfer step uses an intermediate transfer member, and primarily transfers a visible image onto the intermediate transfer member using the intermediate transfer member and then secondarily transfers the visible image onto the recording medium. A more preferable embodiment of the transfer step uses toners of two or more colors, preferably full-color toners, and includes a primary transfer step of transferring visible images onto an intermediate transfer member to form a composite transfer image and a secondary transfer step of transferring the composite transfer image onto a recording medium.

The transferring can be performed by, for example, charging the visible image on the electrostatic latent image bearer (photoconductor) using a transfer charger. The transferring can be performed by the transfer unit. A preferable embodiment of the transfer unit includes a primary transfer unit configured to transfer visible images onto an intermediate transfer member to form a composite transfer image and a secondary transfer unit configured to transfer the composite transfer image onto a recording medium.

The intermediate transfer member is not particularly limited and may be appropriately selected from known transfer members depending on the intended purpose. Preferable examples of the intermediate transfer member include, but are not limited to, a transfer belt.

The transfer unit (the primary transfer unit and the secondary transfer unit) preferably includes a transfer device configured to charge the visible image formed on the electrostatic latent image bearer (photoconductor) to release the visible image to the side of the recording medium. The transfer devices may be one or more.

Examples of the transfer device include, but are not limited to, corona transfer devices using corona discharge, transfer belts, transfer rollers, pressure-transfer rollers, and adhesion-transfer devices.

The recording medium is not particularly limited and may be appropriately selected from known recording media (recording paper sheets).

—Fixing Step and Fixing Unit—

The fixing step is a step of fixing the visible image transferred onto the recording medium using a fixing device. The fixing step may be performed every time when the developer of each color is transferred onto the recording medium, or may be performed at one time with the developers of all colors being laminated.

The fixing device is not particularly limited and may be appropriately selected depending on the intended purpose. The fixing device is preferably a known heat-press unit. Examples of the heat-press unit include, but are not limited to, a combination of a heating roller and a press roller, and a combination of a heat roller, a press roller, and an endless belt.

The fixing device is preferably a unit that includes a heating body equipped with a heat generator, a film in contact with the heating body, and a press member pressed against the heating body via the film, and is configured to allow a recording medium carrying an unfixed image to pass between the film and the press member to heat-fix the unfixed image. Typically, heating performed by the heat-press unit is preferably performed at from 80° C. through 200° C.

In the present disclosure, in combination with or instead of the fixing step and the fixing unit, for example, a known photofixing device may be used depending on the intended purpose.

—Other Steps and Other Units—

The charge-eliminating step is a step of applying charge-elimination bias to the electrostatic latent image bearer to eliminate the charge of the electrostatic latent image bearer. The charge-eliminating step can be suitably performed by a charge-eliminating unit.

The charge-eliminating unit is not particularly limited as long as the charge-eliminating unit can apply charge-elimination bias to the electrostatic latent image bearer. The charge-eliminating unit may be appropriately selected from known charge eliminators. Suitable examples of the charge-eliminating unit include, but are not limited to, charge-eliminating lamps.

The cleaning step is a step of removing the toner remaining on the electrostatic latent image bearer. The cleaning step can be suitably performed by a cleaning unit.

The cleaning unit is not particularly limited as long as the cleaning unit can remove the toner remaining on the electrostatic latent image bearer. The cleaning unit is appropriately selected from known cleaners. Suitable examples of the cleaner include, but are not limited to, magnetic-brush cleaners, electrostatic-brush cleaners, magnetic-roller cleaners, blade cleaners, brush cleaners, and web cleaners.

The recycling step is a step of conveying the toner removed in the cleaning step to the developing unit for recycling. The recycling unit can be suitably performed by a recycling unit. The recycling unit is not particularly limited, and examples of the recycling unit include, but are not limited to, known conveying units.

The controlling step is a step of controlling each of the above-described steps. Each step can be suitably performed by a controlling unit.

The controlling unit is not particularly limited and may be appropriately selected depending on the intended purpose, as long as the controlling unit can control operation of each of the above-described units. Examples of the controlling unit include, but are not limited to, devices such as sequencers and computers.

Figure 2:
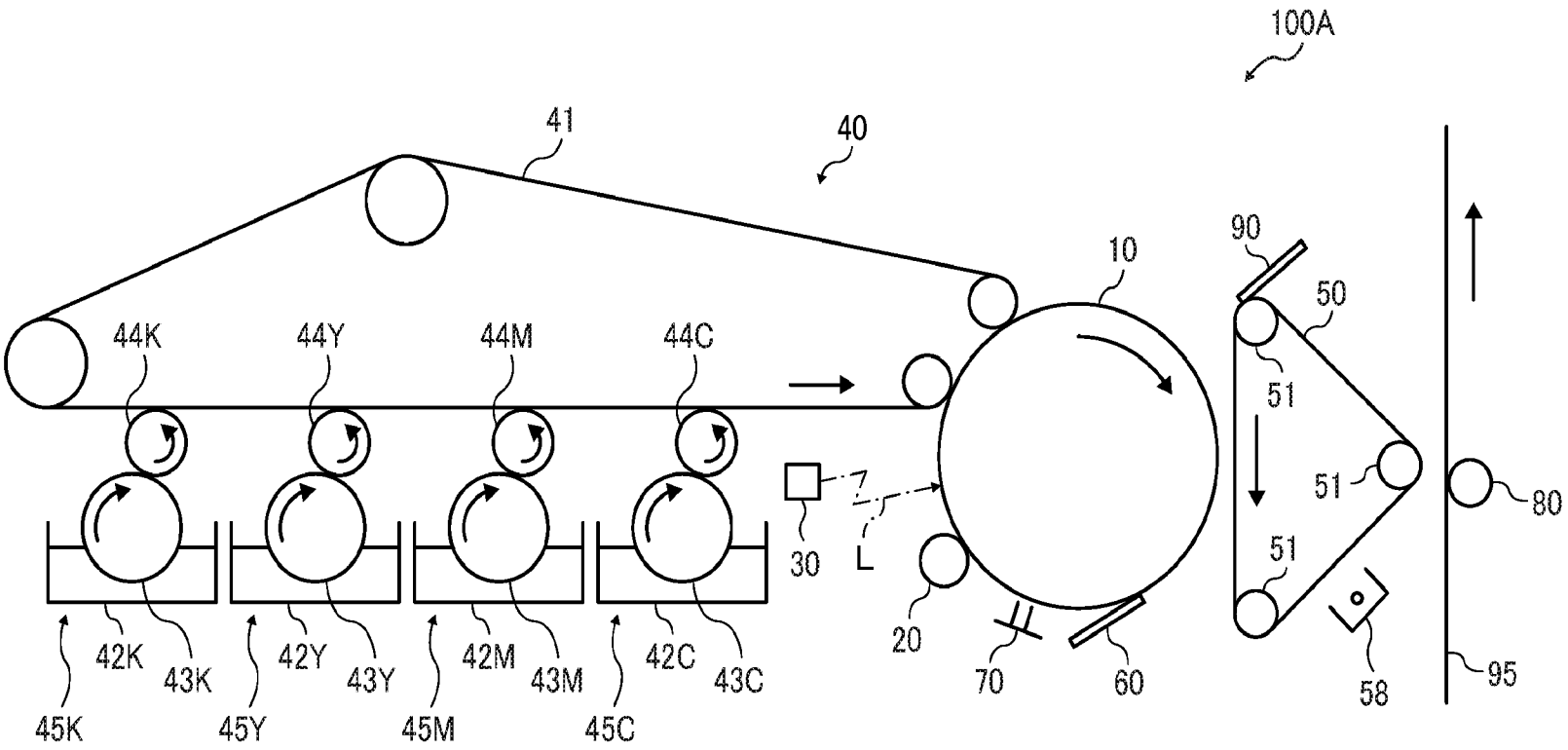
FIG. 2 is an explanatory view illustrating one embodiment of an image forming apparatus of the present disclosure.

A first example of the image forming apparatus of the present disclosure is illustrated in FIG. 2. An image forming apparatus 100A includes a photoconductor drum 10, a charging roller 20, an exposing device 30, a developing device 40, an intermediate transfer belt 50, a cleaning device 60 including a cleaning blade, and a charge-eliminating lamp 70.

The intermediate transfer belt 50 is an endless belt that is supported in a stretched manner by three rollers 51 disposed at the inner side of the intermediate transfer belt 50. The intermediate transfer belt 50 can move in a direction indicated with the arrow in FIG. 2. Part of the three rollers 51 also functions as a transfer bias roller capable of applying transfer bias (primary transfer bias) to the intermediate transfer belt 50. Moreover, a cleaning device 90 including a cleaning blade is disposed near the intermediate transfer belt 50. Furthermore, a transfer roller 80, which is capable of applying transfer bias (secondary transfer bias) for transferring a toner image to transfer paper 95, is disposed so as to face the intermediate transfer belt 50. Around the intermediate transfer belt 50, a corona-charging device 58 configured to apply charges to the toner image transferred to the intermediate transfer belt 50 is disposed in a region from the contact area of the photoconductor drum 10 and the intermediate transfer belt 50 to the contact area of the intermediate transfer belt 50 and the transfer paper 95 along the rotation direction of the intermediate transfer belt 50.

The developing device 40 includes a developing belt 41, and a black-developing unit 45K, a yellow-developing unit 45Y, a magenta-developing unit 45M, and a cyan-developing unit 45C arranged around the developing belt 41. The developing units 45K, 45Y, 45M, and 45C for each color respectively include developer housing units 42K, 42Y, 42M, and 42C, developer-supply rollers 43K, 43Y, 43M, and 43C, and developing rollers (developer bearers) 44K, 44Y, 44M, and 44C. The developing belt 41 is an endless belt supported by a plurality of belt rollers in a stretched manner and can move in a direction indicated with the arrow in FIG. 2. Part of the developing belt 41 is in contact with the photoconductor drum 10.

Next, an image forming method using the image forming apparatus 100A will be described. First, a surface of the photoconductor drum 10 is uniformly charged using the charging roller 20, and the exposing device 30 is used to apply exposure light L to the photoconductor drum 10 to form an electrostatic latent image. Next, the electrostatic latent image formed on the photoconductor drum 10 is developed with a toner supplied from the developing device 40 to form a toner image. The toner image formed on the photoconductor drum 10 is transferred (primary transfer) onto the intermediate transfer belt 50 by the action of transfer bias applied from the roller 51, and is transferred (secondary transfer) onto transfer paper 95 by the action of transfer bias applied from the transfer roller 80. Meanwhile, the toner remaining on the surface of the photoconductor drum 10 from which the toner image has been transferred to the intermediate transfer belt 50 is removed by the cleaning device 60, followed by eliminating the charges using the charge-eliminating lamp 70.

Figure 3:
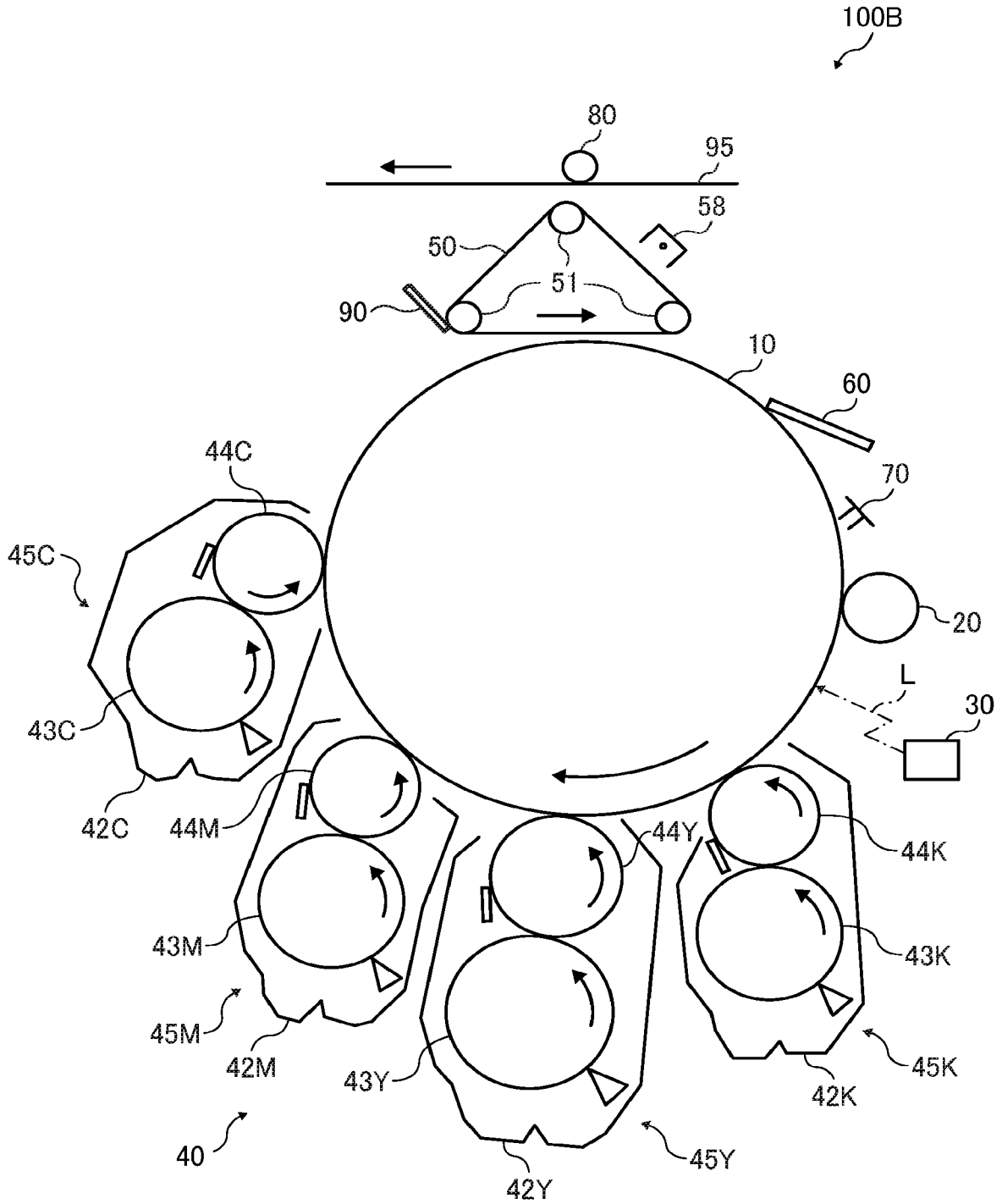
FIG. 3 is an explanatory view illustrating another embodiment of an image forming apparatus of the present disclosure.

A second example of the image forming apparatus of the present disclosure is illustrated in FIG. 3. An image forming apparatus 100B has the same configuration as the configuration of the image forming apparatus 100A, except that the developing belt 41 is not disposed, and the black-developing unit 45K, the yellow-developing unit 45Y, the magenta-developing unit 45M, and the cyan-developing unit 45C are disposed around the photoconductor drum 10 so as to directly face the photoconductor drum 10.

Figure 4:
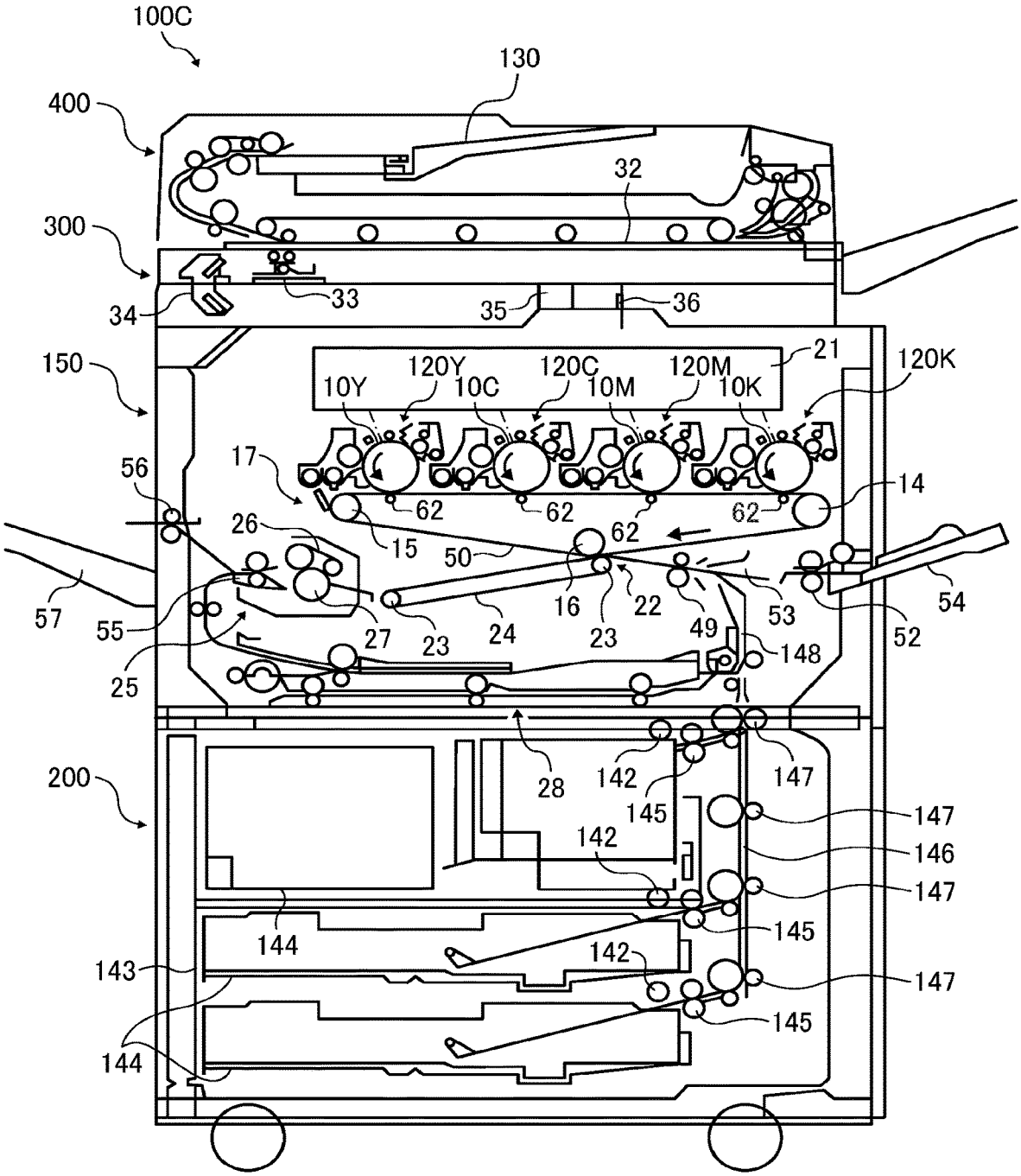
FIG. 4 is an explanatory view illustrating another embodiment of an image forming apparatus of the present disclosure.

A third example of the image forming apparatus of the present disclosure is illustrated in FIG. 4. An image forming apparatus 100C is a tandem color-image forming apparatus and includes a photocopier main body 150, a paper feeding table 200, a scanner 300, and an automatic document feeder (ADF) 400.

An intermediate transfer belt 50 disposed in a central area of the photocopier main body 150 is an endless belt supported by three rollers 14, 15, and 16 in a stretched manner. The intermediate transfer belt 50 can move in a direction indicated with the arrow in FIG. 4. A cleaning device 17 including a cleaning blade configured to remove a toner remaining on the intermediate transfer belt 50, from which a toner image has been transferred to a recording paper sheet, is disposed near the roller 15. A yellow image forming unit 120Y, a cyan image forming unit 120C, a magenta image forming unit 120M, and a black image forming unit 120K (each of which is hereinafter referred to as "image forming unit 120" when not distinguished) are arranged along the paper conveying direction so as to face the intermediate transfer belt 50 supported by the rollers 14 and 15 in a stretched manner.

An exposing device 21 is disposed near the image forming units 120. A secondary-transfer device 22 including a secondary-transfer belt 24 is disposed at a side of the intermediate transfer belt 50 opposite to a side where the image forming units 120 are disposed. The secondary-transfer belt 24 is an endless belt supported by a pair of rollers 23 in a stretched manner, and a recording paper sheet conveyed on the secondary-transfer belt 24 and the intermediate transfer belt 50 can come into contact with each other between the rollers 16 and 23.

A fixing device 25 is disposed near the secondary-transfer belt 24. The fixing device 25 includes a fixing belt 26 that is an endless belt supported by a pair of rollers in a stretched manner, and a press roller 27 disposed so as to be pressed against the fixing belt 26. A sheet reverser 28 configured to reverse a recording paper sheet when images are formed on both sides of the recording paper sheet is disposed near the secondary-transfer belt 24 and the fixing device 25.

Next, a method for forming a full-color image using the image forming apparatus 100C will be described. First, a color document is set on a document table 130 of the automatic document feeder (ADF) 400. Alternatively, the automatic document feeder 400 is opened, a color document is set on a contact glass 32 of a scanner 300, and then the automatic document feeder 400 is closed.

In the case where the document is set on the automatic document feeder 400, once a start switch is pressed, the document is conveyed to the contact glass 32, and then the scanner 300 is driven to scan the document with a first carriage 33 equipped with a light source and a second carriage 34 equipped with a mirror. In the case where the document is set on the contact glass 32, once a start switch is pressed, the scanner 300 is immediately driven to scan the document with the first carriage 33 equipped with a light source and the second carriage 34 equipped with a mirror. At this time, the surface of the document reflects light emitted from the first carriage 33 and the second carriage 34 reflects the reflected light. A reading sensor 36 receives the reflected light via an imaging forming lens 35. In this manner, the document is read to obtain image information of black, yellow, magenta, and cyan.

Figure 5:
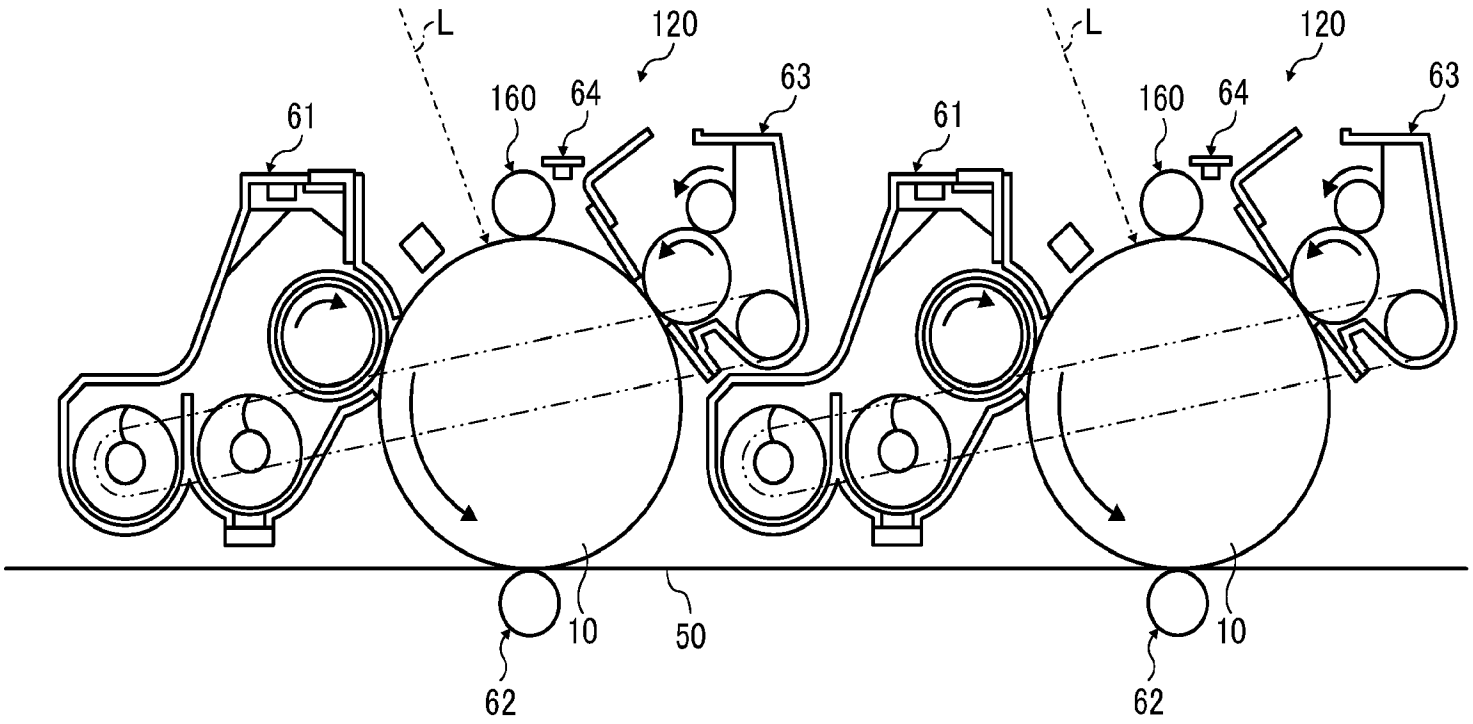
FIG. 5 is an explanatory view illustrating an image forming unit.

Image information of each color is transmitted to a corresponding image forming unit 120 to form a toner image of each color. As illustrated in FIG. 5, the image forming unit 120 of each color includes a photoconductor drum 10, a charging roller 160 configured to uniformly charge the photoconductor drum 10, a developing device 61 configured to develop the electrostatic latent image with a developer of each color to form a toner image of each color, a transfer roller 62 configured to transfer the toner image onto the intermediate transfer belt 50, a cleaning device 63 including a cleaning blade, and a charge-eliminating lamp 64.

The color toner images formed by the image forming units 120 are sequentially transferred (primary transfer) onto the moving intermediate transfer belt 50 supported by the rollers 14, 15, and 16 in a stretched manner, and are superimposed to form a composite toner image.

Meanwhile, one of paper feeding rollers 142 of the paper feeding table 200 is selectively rotated to feed recording paper sheets from one of vertically stacked paper feeding cassettes 144 housed in a paper bank 143. The recording paper sheets are separated one by one by a separation roller 145. The separated sheet is fed to a paper feeding path 146, and is conveyed by a conveyance roller 147 to guide the sheet to a paper feeding path 148 in the photocopier main body 150. Then, the sheet is stopped by colliding with a registration roller 49. Alternatively, paper feeding rollers are rotated to feed recording paper sheets on a bypass feeder 54. The recording paper sheets are separated one by one by a separation roller 52. The separated sheet is guided to a manual paper feeding path 53, and is stopped by colliding with the registration roller 49. The registration roller 49 is typically grounded in use, but the registration roller 49 may be used with bias being applied in order to remove paper dusts of the recording paper sheet.

Next, the registration roller 49 is rotated in synchronization with the movement of the composite toner image formed on the intermediate transfer belt 50, to send the recording paper sheet between the intermediate transfer belt 50 and the secondary-transfer belt 24. The composite toner image is transferred (secondary transfer) onto the recording paper sheet. The toner remaining on the intermediate transfer belt 50, from which the composite toner image has been transferred, is removed by the cleaning device 17.

The recording paper sheet, onto which the composite toner image has been transferred, is conveyed by the secondary-transfer belt 24 and then the composite toner image is fixed by the fixing device 25. Next, the traveling path of the recording paper sheet is switched by a switch claw 55 and the recording paper sheet is ejected onto a paper ejection tray 57 by an ejection roller 56. Alternatively, the traveling path of the recording paper sheet is switched by the switch claw 55 and the recording paper sheet is reversed by the sheet reverser 28. After an image is formed on the rear surface of the recording paper sheet in the same manner as described above, the recording paper sheet is ejected onto the paper ejection tray 57 by the ejection roller 56.

A printing method of the present disclosure includes a step of forming, on a recording medium, a toner image of the toner of the present disclosure using the image forming apparatus of the present disclosure.

EXAMPLES

The present disclosure will be described in more detail by way of Examples and Comparative Examples. However, the present disclosure should not be construed as being limited to the following Examples. In the Examples, "part(s)" means "part(s) by mass" unless otherwise specified.

(Production of Inorganic Particles 1)

—Production of Silica Particles—

A silica compound, octamethylcyclotetrasiloxane was heated and vaporized, and was mixed with oxygen and nitrogen. The resultant mixture was introduced into a center tube of a concentric triple-tube burner. Hydrogen and nitrogen were mixed and introduced into the second circular tube disposed around the circumference of the center tube. Moreover, air was introduced into the third circular tube disposed around the circumference of the second circular tube. The introduced compounds were burnt to obtain silica particles, which were trapped and collected through a metal filter.

—Surface Treatment—

The silica particles obtained as described above were charged into a fluidized-bed reactor. In a nitrogen atmosphere, dimethyl silicone oil was supplied at a rate of 8 g/min for 40 minutes to the fluidized-bed reactor heated to 250° C. to subject the surfaces of the silica particles to a hydrophobization treatment.

The inorganic particles 1 obtained were found to have a volume average particle diameter of 26 nm and a BET specific surface area of 50 $m^2/g$.

(Production of Inorganic Particles 2)

Inorganic particles 2 having a volume average particle diameter of 12 nm and a BET specific surface area of 300 $m^2/g$ were obtained in the same manner as in the production of the inorganic particles 1.

Example 1

—Production of Toner Base Particles—

Polyester resin: 87 parts

Rice wax (TOWAX-3F16, available from TOA KASEI CO., LTD.): 3 parts

Carbon black (#44, available from Mitsubishi Kasei Corporation): 8 parts

Azo iron compound (T-77, available from Hodogaya Chemical Co., Ltd.): 2 parts

The toner raw materials of the above kinds and amounts were premixed using a HENSCHEL MIXER (FM20B, available from Mitsui Miike Chemical Engineering Machinery, Co., Ltd.). The resultant mixture was melted and kneaded at a temperature of 120° C. using a biaxial kneader (PCM-30, available from Ikegai Corp). The kneaded product was rolled using a roller so as to have a thickness of 2.7 mm, and was cooled to room temperature using a belt cooler. The resultant was roughly pulverized using a hammermill to have a size of from 200 μm through 300 μm. Then, a supersonic jet mill, "LABOJET" (available from Nippon Pneumatic Mfg. Co., Ltd.) was used to finely pulverize the roughly pulverized particles. The resultant was classified using an air-flow classifier (MDS-I, available from Nippon Pneumatic Mfg. Co., Ltd.) with a degree of opening of the louver being appropriately adjusted so that the weight average particle diameter of the classified particles would be 5.8±0.2 μm. Through the above-described procedure, toner base particles were obtained.

—Production of Toner—

The inorganic particles 1 (1.00 part) and the inorganic particles 2 (0.03 parts) were added to the toner base particles (100 parts), followed by mixing under stirring using a HENSCHEL MIXER, to produce a toner of Example 1.

—Measurement of Particle Size Distribution of Inorganic Particles—

The following steps (1) to (3) were sequentially performed to measure the particle size distribution on the number basis of primary particles of the inorganic particles.

(1) An image of the toner was obtained using a scanning electron microscope SU8200 series (available from Hitachi High-Technologies Corporation) in a state where the inorganic particles are attached on the toner surface.

(2) The image obtained was binarized using image processing software "A-zokun" (available from Asahi Kasei Engineering Corporation) to calculate circle-equivalent diameters of the inorganic particles. One-thousand inorganic particles were measured for the circle-equivalent diameters of the inorganic particles.

(3) The number of classes was determined based on a formula below, and a histogram was created to obtain a particle size distribution.

The number of classes=$1+\log_2 n$ (n denotes the number of data of the equivalent circle diameters of the inorganic particles).

From the particle size distribution obtained, presence of two peaks was confirmed in the range of from 5 nm through 50 nm.

With the highest peak among the plurality of peaks being a peak n1 and the second highest peak among the plurality of peaks being a peak n2, and the particle diameter (nm) at the peak n1 being n1d, the particle diameter (nm) at the peak n2 being n2d, a height of the peak n1 being n1h, and a height of the peak n2 being n2h, the n1d was 12 nm and the n2d was 25 nm, and {(n2h/n1h)×100} was 30. Details are presented in Table 1.

Examples 2 to 7 and Comparative Examples 1 and 2

Various toners were obtained in the same manner as in Example 1 except that the amount of the inorganic particles 2 was changed as described in Table 1 below.

TABLE 1

| | Amount of inorganic particles 1 (part) | Amount of inorganic particles 2 (parts) | n1d (nm) | n2d (nm) | (n2h/n1h) × 100 |
|---|---|---|---|---|---|
| Example 1 | 1.00 | 0.03 | 25 | 12 | 30 |
| Example 2 | 1.00 | 0.04 | 25 | 12 | 40 |
| Example 3 | 1.00 | 0.05 | 25 | 12 | 50 |
| Example 4 | 1.00 | 0.06 | 25 | 12 | 60 |
| Example 5 | 1.00 | 0.07 | 25 | 12 | 70 |
| Example 6 | 1.00 | 0.08 | 25 | 12 | 80 |
| Example 7 | 1.00 | 0.09 | 25 | 12 | 90 |
| Comparative Example 1 | 1.00 | 0.02 | 25 | 12 | 20 |
| Comparative Example 2 | 1.00 | 0.10 | 25 | 12 | 100 |

(Evaluation of Stability Regarding Amount of Toner Conveyed on Developing Roller)

The toner was loaded into IPSIO SP C220 (available from Ricoh Company, Ltd.) and paper sheets (available from Ricoh Company, Ltd., Type 6200, A4 sheet) were used in a 2,000-sheets feeding test. When the image was printed on the $500^{th}$ paper sheet and the $2,000^{th}$ paper sheet, the toner on the developing roller was sucked using a vacuum pump and was trapped using a filter (available from GE Healthcare Japan Corporation, qualitative filter paper (Whatman grade 1)). The weight of the trapped toner was divided by the area of the sucked toner to calculate the weight of the toner per a unit area. When the toner weight per the unit area at the time of printing on the $500^{th}$ paper sheet was denoted by A and the toner weight per the unit area at the time of printing on the $2,000^{th}$ paper sheet was denoted by B, the value of $|A-B|/A\times100$ was calculated. Evaluation criteria are as follows.

—Evaluation Criteria of Stability Regarding Amount of Toner Conveyed on Developing Roller—

3: 90 or more

2: 80 or more but less than 90

1: Less than 80

(Evaluation of Contamination to Photoconductor)

The toner was loaded into IPSIO SP C220 (available from Ricoh Company, Ltd.) and paper sheets (available from Ricoh Company, Ltd., Type 6200, A4 sheet) were used in a 2,000-sheets feeding test. Printing operation was stopped during printing on the $2,000^{th}$ paper sheet, and a piece of scotch tape was attached on the whole surface of the exposed portion of the photoconductor. The scotch tape was peeled off and attached on Type 6000 grain long paper (available from Ricoh Company, Ltd.) which was then stored. The tape was measured for L* using X-rite (available from Videojet X-Rite K.K.).

Evaluation criteria are as follows.

—Evaluation Criteria of Contamination to Photoconductor—

3: 92 or more

2: 91.5 or more but less than 92

1: Less than 91.5

Results are presented in Table 2.

TABLE 2

| | Evaluation of stability regarding amount of toner conveyed on developing roller | Evaluation of contamination to photoconductor |
|---|---|---|
| Example 1 | 3 | 2 |
| Example 2 | 3 | 2 |
| Example 3 | 3 | 2 |
| Example 4 | 3 | 2 |
| Example 5 | 3 | 2 |
| Example 6 | 2 | 3 |
| Example 7 | 2 | 3 |
| Comparative Example 1 | 3 | 1 |
| Comparative Example 2 | 1 | 3 |

It is confirmed from the results in Table 2 that the toners of Examples are excellent in stability regarding the amount of the toner conveyed on the developing roller and can sufficiently prevent contamination to the photoconductor.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A toner, comprising:

a toner base particle including a binder resin; and an external additive including inorganic particles including primary particles having a particle diameter distribution with a plurality of peaks in a range of from 5 nm through 50 nm, wherein the particle diameter distribution of the primary particles satisfies all of expressions (1) to (3) below:

$$n1d>n2d \quad (1);$$

$$10<(n1d+n2d) \quad (2); \text{ and}$$

$$30\leq\{(n2h/n1h)\times100\}<100 \quad (3),$$

where n1d is a particle diameter (nm) at a peak n1, which is a highest peak among the plurality of peaks, n2d is a particle diameter (nm) at a peak n2, which is a second highest peak among the plurality of peaks, and n1h is a height of the peak n1 and n2h is a height of the peak n2.

2. The toner according to claim 1, wherein the inorganic particles are at least one selected from the group consisting of silica, alumina, and titanic.

3. The toner according to claim 1, wherein the external additive includes two or more same kinds of inorganic particles having different average particle diameters.

4. A developer comprising:

the toner according to claim 1.

5. A toner storage container, comprising:

the toner according to claim 1, which is stored in the toner storage container.

6. An image forming apparatus, comprising:

an electrostatic latent image bearer;

an electrostatic latent image forming device configured to form an electrostatic latent image on the electrostatic latent image bearer;

a developing device containing a developer and configured to develop the electrostatic latent image with the developer to form a visible image;

a transfer device configured to transfer the visible image onto a recording medium; and a fixing device configured to fix the visible image transferred onto the recording medium, wherein the developer includes the toner according to claim 1.

7. An image forming method comprising:

forming an electrostatic latent image on an electrostatic latent image hearer;

developing the electrostatic latent image with a developer to form a visible image;

transferring the visible image onto a recording medium; and fixing the visible image transferred onto the recording medium, wherein the developer includes the toner according to claim 1.

8. A printed matter producing method comprising:

forming a toner image with the toner according to claim 1 on a recording medium.

9. The toner of claim 1, wherein the particle diameter at peak n1 is more than twice the particle diameter at peak n2.

* * * * *